US005665511A

United States Patent [19]

Imai et al.

[11] Patent Number: 5,665,511

[45] Date of Patent: Sep. 9, 1997

[54] SURFACE-TREATED INORGANIC FINE PARTICLE AND ELECTROPHOTOGRAPHIC DEVELOPER USING THE SAME

[75] Inventors: Takashi Imai; Satoshi Inoue; Masanori Ichimura; Yutaka Sugizaki; Susumu Saito; Masaru Miura; Michio Take; Yasuo Yamamoto; Koji Fukushima; Manabu Serizawa, all of Minami Ashigara, Japan

[73] Assignee: Fuji Xerox Co., Ltd., Tokyo, Japan

[21] Appl. No.: 471,729

[22] Filed: Jun. 6, 1995

Related U.S. Application Data

[60] Continuation of Ser. No. 209,736, Mar. 14, 1994, abandoned, which is a division of Ser. No. 877,245, May 1, 1992, abandoned.

[30] Foreign Application Priority Data

May 14, 1991 [JP] Japan ..... 3-137042

[51] Int. Cl.[6] ..... G03G 9/097

[52] U.S. Cl. ..... 430/110; 430/109; 430/111; 430/903

[58] Field of Search ..... 430/110, 109, 430/111, 903

[56] References Cited

U.S. PATENT DOCUMENTS

| | | | |
|---|---|---|---|
| 3,837,878 | 9/1974 | Beers | 106/308 N |
| 3,873,337 | 3/1975 | Laufer et al. | 106/308 Q |
| 4,116,919 | 9/1978 | Elias et al. | 260/375 B |
| 4,173,560 | 11/1979 | Homan et al. | 260/375 B |
| 4,395,352 | 7/1983 | Kulkarni et al. | 252/321 |
| 4,566,908 | 1/1986 | Nakatani et al. | 106/308 N |
| 4,618,556 | 10/1986 | Takenouchi | 430/110 |
| 4,704,425 | 11/1987 | Lagarde et al. | 524/492 |
| 4,828,954 | 5/1989 | Hashimoto et al. | 430/110 |
| 4,849,022 | 7/1989 | Kobayashi et al. | 106/490 |
| 4,911,903 | 3/1990 | Unger et al. | 423/335 |
| 4,973,540 | 11/1990 | Machida et al. | 430/110 |
| 5,009,874 | 4/1991 | Parmentier et al. | 423/335 |
| 5,066,558 | 11/1991 | Hikake et al. | 430/109 |
| 5,215,849 | 6/1993 | Makuta et al. | 430/110 |

FOREIGN PATENT DOCUMENTS

| | | | |
|---|---|---|---|
| 58-185405 | 10/1983 | Japan . | |
| 62-129862 | 6/1987 | Japan . | |
| 1-203478 | 8/1989 | Japan | 430/109 |
| 1-40979 | 9/1989 | Japan . | |
| 3-70778 | 3/1991 | Japan . | |
| 3-101742 | 4/1991 | Japan | 430/109 |
| 90/02779 | 3/1990 | WIPO . | |

OTHER PUBLICATIONS

Patent & Trademark Office English Translation of Japanese Patent Appln. 1–203478 (Pub. Aug. 1989).

Patent & Trademark Office English Translation of Japanese Patent Appln. 3–101742 (Pub. Apr. 1991).

*Primary Examiner*—Janis L. Dote

*Attorney, Agent, or Firm*—Oliff & Berridge

[57] ABSTRACT

A surface-treated inorganic fine particle includes an inorganic fine particle, a hydrophobizing agent deposited on the surface of the inorganic fine particle and an amino group-containing coupling agent deposited on the surface of the inorganic fine particle, wherein the hydrophobizing agent and the amino group-containing coupling agent in a ratio of 1/(0.01 to 0.1) by weight are deposited on the surface of the inorganic fine particle by treating the surface of the inorganic fine particle with the hydrophobizing agent and the amino group-containing coupling agent. An electrophotographic developer contains toner particles and the surface-treated inorganic fine particles.

18 Claims, No Drawings

SURFACE-TREATED INORGANIC FINE PARTICLE AND ELECTROPHOTOGRAPHIC DEVELOPER USING THE SAME

This is a continuation of application Ser. No. 08/209,736 filed Mar. 14, 1994, now abandoned, which in turn is a division of application Ser. No. 07/877,245 filed May 1, 1992, now abandoned.

FIELD OF THE INVENTION

This invention relates to a surface-treated inorganic fine particle which is useful as an external additive for electrophotographic developers. It also relates to an electrophotographic developer using the same.

BACKGROUND OF THE INVENTION

Inorganic fine particles such as metal oxide powders have been conventionally used for electrophoto-graphic developers to improve fluidity. Further, there have been made many proposals with regard to the control of the charge quantities (i.e., the tribocharges) of the developers, which have an influence on developability. When charge control is made by an external additive, inorganic fine particle whose surface has been treated with a positive or negative surface treating agent has been conventionally added to a toner. For example, a fine silica particle having a negative chargeability is treated with an amino group-containing silane coupling agent to obtain an electrophotographic developer having a positive chargeability. Further, there have been proposed fine metal oxide particles whose surfaces are treated with 5 to 20% by weight of an amino group-containing silane coupling agent as well as 5 to 20% by weight of a hydrophobizing agent (i.e., agent giving a hydrophobic property) to impart a hydrophobic property to the developer, each amount being based on the weight of the fine metal oxide particle [see, JP-A-58-185405 (the term "JP-A" as used herein means an "unexamined published Japanese patent application")].

Further, an electrophotographic developer having a positive chargeability comprising a toner composition containing a binder resin and a colorant, and a silica fine particle which is vapor phase-oxidized with a silicon halogen compound is described in JP-B-1-40979 (the term "JP-B" as used herein means an "examined Japanese patent publication").

Chargeability and charge quantity can be controlled by inorganic fine particles conventionally proposed. However, the mixing of the toner (toner admixability) with the developer is not sufficiently made during toner supply, and a toner having a wide charge distribution is formed. Accordingly, there are conventionally problems that developing apparatuses are stained, or background stain on the copied image is formed. There has been not found a technique as yet, which enables the charge control of the toner as well as the improvement of the toner admixability to be simultaneously made. This invention has been performed with a view to solve the above-mentioned problems.

SUMMARY OF THE INVENTION

Accordingly, an object of the present invention is to provide an external additive which achieves the charge control of the toner as well as the improvement of toner admixability to be made.

Another object of the present invention is to provide an electrophotographic developer which can stably keep the charge quantity over a long period of time, is stable against fluctuation in environmental conditions and has a prolonged service life.

The present inventors have made studies and found that the charge control of the toner as well as the toner admixability can be improved by using a hydrophobizing agent and an amino group-containing coupling agent in a specific ratio when inorganic fine particle is treated with the hydrophobizing agent and the amino group-containing coupling agent. Further, the present inventors have found that the problems described above can be solved by using inorganic fine particle whose surface has been treated with the hydrophobizing agent and the amino group-containing coupling agent in combination with other inorganic fine particle.

Accordingly, the above objects of the present invention is achieved by surface-treated inorganic fine particle comprising an inorganic fine particle, a hydrophobizing agent deposited on the surface of said inorganic fine particle and an amino group-containing coupling agent deposited on the surface of said inorganic fine particle, wherein said hydrophobizing agent and said amino group-containing coupling agent in a ratio of 1/(0.01 to 0.1) by weight are deposited on the surface of said inorganic fine particle by treating the surface of the inorganic fine particle with the hydrophobizing agent and the amino group-containing coupling agent; or an electrophotographic developer comprising toner particles and the surface-treated inorganic fine particles.

Further, the present invention preferably provides as a preferable embodiment an electrophotographic developer comprising toner particles, surface-treated inorganic fine particles described above and further other inorganic fine particles.

DETAILED DESCRIPTION OF THE INVENTION

Now, the present invention will be illustrated in more detail below.

Inorganic fine particles, which themselves are negatively charged, or are negatively charged by friction between the particles and iron powder, or exhibit zero chargeability, are used in the present invention. Examples of such inorganic particles which can be used in the present invention include metal oxides such as silica, titanium oxide, zirconium oxide and alumina. These inorganic fine particles have a particle size of generally 5 to 200 nm, preferably 20 to 80 nm, more preferably 25 to 60 nm and most preferably30 to 50 nm.

Examples of the hydrophobizing agent which can be used for the treatment of the surfaces of the inorganic fine particles include silane coupling agents such as chlorosilane, alkoxysilanes, silazane and silylating agents, silicone oil, titanate coupling agents, aluminum coupling agents and zirconium aluminate coupling agents.

Organosilicon compounds can be preferably used as the amino group-containing coupling agent. Examples of the amino group-containing coupling agent include γ-(2-aminoethyl)aminopropyltrimethoxysilane, γ-(2-aminoethyl)- aminopropylmethyldimethoxysilane, γ-aminopropyltriethoxysilane, γ-anilinopropyltrimethoxysilane and aminosilanes represented by the following formulas.

$$H_2NC_2H_4NHC_3H_6Si(OCH_3)_3$$

-continued $$H_2NC_2H_4NHC_3H_6Si(OCH_3)_2$$

$$H_2NC_3H_6Si(OC_2H_5)_3$$

$$C_6H_5NHC_3H_6Si(OCH_3)_3$$

$$C_{18}H_{37}\overset{\oplus}{N}(CH_2)_3Si(OCH_3)_3Cl^{\ominus}$$

$$C_{17}H_{35}\overset{\oplus}{N}(CH_2)_3Si(OCH_3)_3Cl^{\ominus}$$

Methods for treating the inorganic fine particles with the hydrophobizing agent and the amino group-containing coupling agent include methods wherein inorganic fine particles are dispersed in an organic solvent solution, an alcohol solution or an aqueous solution of a hydrophobizing agent and an amino group-containing coupling agent with stirring and then the resulting dispersion is heated and dried, and methods wherein inorganic fine particles are dispersed in an alcohol, an organic solvent or water, a hydrophobizing agent and an amino group-containing coupling agent are then added to the resulting dispersion, and the mixture is heated and dried.

The hydrophobizing agent and the amino group-containing coupling agent are used in a combined amount (i.e., a total amount) of 0.05 to 0.2 parts by weight per one part by weight of inorganic fine particle to be treated. The hydrophobizing agent and the amino group containing coupling agent are used in such a proportion that the amount of the amino group-containing coupling agent should be 0.01 to 0.1 part by weight and preferably 0.03 to 0.1 part by weight, per one part by weight of the hydrophobizing agent. When the amount of the amino group-containing coupling agent is more than 0.1 part by weight, an effect due to a positively charge occurs, the resulting charge distribution is broad, and further there are caused disadvantages that cloud is formed and background stain is formed on copied images.

The hydrophobizing agent and the amino group-containing coupling agent in a ratio of 1/(0.01 to 0.1) by weight, preferably 1/(0.03 to 0.1) by weight are deposited on the surface of the inorganic fine particle.

The electrophotographic developer of the present invention comprises a toner and the inorganic fine particles whose surfaces have been treated with the hydrophobizing agent and the amino group-containing coupling agent. The amount of the surface-treated inorganic fine particles to be added is in the range of preferably 0.1 to 10% by weight and more preferably 0.5 to 5% by weight, based on the amount of the toner.

The electrophotographic developer of the present invention can contain the above-described surface-treated inorganic fine particles as an external additive. If desired, the electrophotographic developer of the present invention may contain one or more of other inorganic fine particles in addition to the above-described surface-treated inorganic fine particles as the essential component of the present invention. In this case, the combined amount (i.e., the total amount) of the inorganic fine particles added is in the range of preferably 0.1 to 10% by weight and more preferably 0.5 to 5% by weight, based on the amount of the toner.

Any of toners comprising conventional colorant and conventional binder resin can be used as the toner to be contained in the electrophotographic developer of the present invention without particular limitation.

Examples of the binder resin which can be used for the toner particles include homopolymers and copolymers of styrenes (e.g., styrene, chlorostyrene), monoolefins (e.g., ethylene, propylene, butylene, isoprene), vinyl esters (e.g., vinyl acetate, vinyl propionate, vinyl benzoate, vinyl butyrate), α-methylene aliphatic monocarboxylic acid esters (e.g., methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate), vinyl ethers (e.g., vinyl methyl ether, vinyl ethyl ether, vinyl butyl ether) and vinyl ketones (e.g., vinyl methyl ketone, vinyl hexyl ketone, vinyl isopropenyl ketone). Examples of typical binder resins include polystyrene, styrene-alkyl acrylate copolymers, styrene-alkyl methacrylate copolymers, styrene-acrylonitrile copolymers, styrene-butadiene co-polymers, styrene-maleic anhydride copolymers, polyethylene and polypropylene. Further, polyesters, polyurethanes, epoxy resins, silicone resins, polyamides, modified rosins, paraffin and wax can be used as the binder resin. Among them, polyesters can be effectively used as the binder resin.

When the polyesters are used as the binder resin for the toners, the toners have negative chargeability without using any charge control agent or with the use of a small amount of a charge control agent, since the polyesters themselves are negative chargeable. However, there is a disadvantage that dependence of chargeability on environmental conditions is great, that is, a difference in the charge quantity between high temperature and high humidity condition and low temperature and low humidity condition is great. This phenomenon is particularly remarkable when other pigments than carbon black are used as colorants for the toners are used. The above-described disadvantage inherent in use of the polyesters can be eliminated when the polyesters are used in the present invention. The exact mechanism by which the disadvantage can be eliminated is not clear so far. It is considered that the negative chargeability of polyester is due to a polar group such as carboxyl group or an ester linkage in which polyesters possess. The chargeability of these polar groups is greatly influenced by a change in temperature and humidity. Hence, it is considered that the chargeability of the toner is influenced by a change in temperature and humidity when the toner is prepared by using a polyester as the binder resin. Further, properties with regard to the change of chargeability of the toner in temperature and humidity can not be greatly improved even when a charge control agent is added to polyester. However, when the inorganic fine particle treated with at least two treating agents in a specific mixing ratio according to the present invention is allowed to exist on the surface of the toner, charge distribution on the surface of the toner particularly under low temperature and low humidity conditions can be made uniform, an exchange of charges between the toner particles is accelerated, the rising of charging can be improved and the distribution of charge is made sharp.

Typical examples of colorants which can be used in the toner include carbon black, Nigrosine dyes, Aniline Blue, Charchoyl Blue, Chrome Yellow, Ultramarine Blue, Du Pont Oil Red, Quinoline Yellow, Methylene Blue Chloride, Phthalocyanine Blue, Malachite Green Oxalate, lamp black, Rose Bengale, C.I. Pigment Red 48:1, C.I. Pigment Red 122, C.I. Pigment Red 75:1, C.I. Pigment Yellow 97, C.I. Pigment Yellow 12, C.I. Pigment Blue 15:1 and C.I. Pigment Blue 15:3.

These toner particles may further contain conventional additives such as a charge control agent and a fixing aid.

The toner particles of the present invention have an average particle size of not larger than about 30 μm, preferably 3 to 20 μm.

The electrophotographic toner of the present invention may be used in the form of either as a one-component developer without a carrier, or a two-component developer with a carrier. However, the two-component developer is preferable.

When a carrier is used, any of conventional carriers can be used without particular limitation. Examples of such carriers include iron powder carrier, ferrite carrier, surface-coated ferrite carrier and magnetic powder dispersion type carrier.

In the preparation of the electrophotographic toner of the present invention, the additives can be deposited on the surfaces of the toner particles by using conventional means such as a high-speed mixer. Concrete examples of the high-speed mixer include Henschel mixer and V type blender.

The present invention is now illustrated in greater detail with reference to Examples, but it should be understood that the present invention is not deemed to be limited thereto.

EXAMPLE 1

Preparation of external additive (1) External additive 1 (Invention)

In 500 g of methanol was dispersed 100 g of $SiO_2$ (having a particle size of about 16 nm, "A130", manufactured by Nippon Aerosil KK) as an inorganic fine particle. A mixture of 10 g of hexamethyldisilazane as the hydrophobizing agent and 0.5 g of γ-aminopropyltriethoxysilane as the amino group-containing coupling agent was added dropwise to the resulting dispersion. The obtained mixture was stirred for one hour and filtered. The resulting product was dried at 120° C. for 5 hours and then crushed in a pin mill to obtain an external additive.

(2) External additive 2 (Comparison)

An external additive was prepared in the same manner as in the preparation of External additive 1 except that the amount of γ-aminopropyltriethoxysilane used was 2.0 g.

(3) External additive 3 (Invention)

An external additive was prepared in the same manner as in the preparation of External additive 1 except that 100 g of amorphous $TiO_2$ (average particle size: 20 nm, Trade name: "TTS", manufactured by Idemitsu Kosan Co., Ltd.) was used.

(4) External additive 4 (Invention)

An external additive was prepared in the same manner as in the preparation of External additive 1 except that $SiO_2$ (having a particle size of 40 nm, "OX50", manufactured by Nippon Aerosil KK) was used as an inorganic fine particle.

Preparation of developer 97 parts by weight of a polyester resin having a Tg of 60° C. and a softening point of 110° C. (manufactured by Dai-Nippon Ink & Chemicals Inc.) and 3 parts by weight of Carmine 6 BC as the colorant were melt-kneaded, crushed and classified to obtain a toner having an average particle size of 8 μm. 1.5 parts by weight of each of the above External additives 1 to 4 was mixed with 100 parts by weight of the toner to obtain each of toner compositions.

Iron powder having an average particle size of 50 μm coated with a fluorine-containing acrylic resin was used as the carrier. Each of developer compositions was prepared by mixing 56 g of each of the toner compositions with 700 g of the carrier. Copying test was carried out by using each developer composition and a copying machine ("FX 5030" manufactured by Fuji Xerox Co., Ltd.).

In the copying test, when the toner composition containing External additive 2 was used, background stain was formed and staining was formed in the copying machine after 2,000 copies were made. On the other hand, when the toner compositions containing each of External additives 1, 3 and 4 were used, the charge quantity was stably remained, background stain was not formed, staining in the copying machine did not occur and an image of good quality could be obtained even after 5,000 copies were made in the copying test.

EXAMPLE 2

External additive 5 (Invention) was prepared in the same manner as in Example 1 except that 100 g of amorphous $TiO_2$ having an average particle size of about 20 nm (manufactured by Idemitsu Kosan Co., Ltd.) was treated with 10 g of decyltrimethoxysilane alone.

Each of toner compositions was prepared by adding 1% by weight of External additive 5 and 0.5% by weight of each of External additives 1 to 4 to the toner of Example 1. In the same manner as in Example 1, a copying test was carried out. In the cases where any of these toner compositions was used, image and the charge quantity were excellent in stability, and background fog and staining in the copying machine were not observed.

EXAMPLE 3

$SiO_2$ (having an average particle size of 40 nm, "OX50" manufactured by Nippon Aerosil KK) as the inorganic fine particles was treated with 15 g of hexamethyldisilazane and 0.5 g of γ-aminopropyltriethoxysilane in the same manner as in Example 1 to obtain External additive 6. In another experiment, the above $SiO_2$ was treated with 15 g of hexamethyldisilazane and 2.0 g of γ-aminopropyltriethoxysilane in the same manner as in Example 1 to obtain External additive 7.

Each of toner compositions was prepared by adding 1% by weight of External additive 4 and 1.0% by weight of each of External additives 6 and 7 to the toner of Example 1.

In the same manner as in Example 1, a copying test was carried out. In the cases where any of these toner compositions was used, image and the charge quantity were excellent in stability, and background fog and staining in the copying machine were not observed.

The surface-treated inorganic fine particles of the present invention have a structure as described above. When the surface-treated inorganic fine particles of the present invention as the external additive are added to the electrophotographic developers, the charge control of the toner as well as the improvement toner admixability can be simultaneously achieved. Since the electrophotographic developers of the present invention contain the surface-treated inorganic fine particle, there can be obtained such an effect that the charge quantity is stable over a long period of time as well as against environmental change, and the developers have a prolonged service life.

While the invention has been described in detail and with reference to specific embodiments thereof, it will be apparent to one skilled in the art that various changes and modifications can be made therein without departing from the spirit and scope thereof.

What is claimed is:

1. An electrophotographic dry developer comprising toner particles and surface-treated inorganic particles, said surface-treated inorganic particles consisting essentially of inorganic particles having an average particle size of 5–200 nm, a hydrophobizing agent selected from the group consisting of titanate coupling agent, aluminum coupling agent and zirconium aluminate coupling agent deposited on the surface of said inorganic particles and an amino group-containing coupling agent deposited on the surface of said inorganic particles, wherein 0.01–0.1 part by weight of said amino group-containing coupling agent is deposited on the surface of said inorganic particles per one part by weight of said hydrophobizing agent.

2. The electrophotographic developer as claimed in claim 1, wherein 0.03–0.1 part by weight of said amino group-containing coupling agent is deposited per one part by weight of said hydrophobizing agent.

3. The electrophotographic developer as claimed in claim 1, wherein said surface-treated inorganic particles are deposited on the surface of the toner particles.

4. The electrophotographic developer as claimed in claim 1, wherein said amino group-containing coupling agent is an organosilicon compound.

5. The electrophotographic developer as claimed in claim 1, wherein said amino group-containing coupling agent is selected form the group consisting of γ-(2-aminoethyl) aminopropyltrimethoxysilane, γ-(2-aminoethyl) aminopropylmethyldimethoxy silane, γ-aminopropyltriethoxy silane, and γ-anilino propyltrimethoxysilane.

6. The electrophotographic developer as claimed in claim 1, wherein said hydrophobizing agent and the amino group-containing coupling agent are present in a combined amount of 0.05–0.2 part by weight per one part by weight of said inorganic particles.

7. The electrophotographic developer as claimed in claim 1, wherein said developer further comprises other inorganic particles in addition to said surface-treated inorganic particles.

8. The electrophotographic developer as claimed in claim 1, wherein said surface-treated inorganic particles are present in an amount of 0.1–10 parts by weight per 100 parts by weight of said toner particles.

9. The electrophotographic developer as claimed in claim 1, wherein said surface-treated inorganic particles are present in an amount of 0.5–5 parts by weight per 100 parts by weight of said toner particles.

10. The electrophotographic developer as claimed in claim 1, wherein said developer further comprises a carrier.

11. An electrophotographic dry developer comprising toner particles and surface-treated inorganic particles, said surface-treated inorganic particles consisting essentially of inorganic particles having an average particle size of 5–80 nm, a hydrophobizing agent selected from the group consisting of titanate coupling agent, aluminum coupling agent and zirconium aluminate coupling agent deposited on the surface of said inorganic particles and an amino group-containing coupling agent deposited on the surface of said inorganic particles, wherein 0.01–0.1 part by weight of said amino group-containing coupling agent is deposited on the surface of said inorganic particles per one part by weight of said hydrophobizing agent.

12. The electrophotographic developer as claimed in claim 11, wherein said surface-treated inorganic particles have an average particle size of 25–60 nm.

13. The electrophotographic developer as claimed in claim 11, wherein said surface-treated inorganic particles have an average particle size of 30–50 nm.

14. The electrophotographic developer as claimed in claim 11, wherein said 0.03–0.1 part by weight of said amino group-containing coupling agent is deposited per one part by weight of said hydrophophobizing agent.

15. The electrophotographic developer as claimed in claim 11, wherein said surface-treated inorganic particles are deposited on the surface of the toner particles.

16. The electrophotographic developer as claimed in claim 11, wherein said amino group-containing coupling agent is an organosilicon compound.

17. The electrophotographic developer as claimed in claim 11, wherein said hydrophobizing agent and the amino group-containing coupling agent are present in a combined amount of 0.05–0.2 part by weight per one part by weight of said inorganic particles.

18. The elctrophotographic developer as claimed in claim 11, wherein said developer further comprises other inorganic particles in addition to said surface-treated inorganic particles.

* * * * *